US010299564B2

(12) United States Patent
Ishida

(10) Patent No.: US 10,299,564 B2
(45) Date of Patent: May 28, 2019

(54) ROD-SHAPED COSMETIC MATERIAL FEEDING CONTAINER

(71) Applicant: TOKIWA CORPORATION, Gifu (JP)

(72) Inventor: Yukikazu Ishida, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 201 days.

(21) Appl. No.: 15/595,287

(22) Filed: May 15, 2017

(65) Prior Publication Data

US 2017/0340088 A1 Nov. 30, 2017

(30) Foreign Application Priority Data

May 24, 2016 (JP) ..... 2016-103366

(51) Int. Cl.

| | |
|---|---|
| ***B43K 21/00*** | (2006.01) |
| ***A45D 40/04*** | (2006.01) |
| ***A45D 40/12*** | (2006.01) |
| *A45D 40/02* | (2006.01) |
| *A45D 40/06* | (2006.01) |

(52) U.S. Cl.

CPC ..... *A45D 40/04* (2013.01); *A45D 40/12* (2013.01); *A45D 40/02* (2013.01); *A45D 40/06* (2013.01); *A45D 40/065* (2013.01)

(58) Field of Classification Search

CPC ..... B43K 21/003; B43K 21/08; B43K 27/04; B43K 27/18

USPC ..... 401/32, 75

See application file for complete search history.

(56) References Cited

FOREIGN PATENT DOCUMENTS

JP 2012-96009 5/2012

*Primary Examiner* — David Walczak
*Assistant Examiner* — Joshua Wiljanen
(74) *Attorney, Agent, or Firm* — Greenblum & Bernstein, P.L.C.

(57) ABSTRACT

The rod-shaped cosmetic material feeding container includes a female screw portion provided with a female screw for screw engagement with a male screw of a rod-shaped cosmetic material support, a coil spring that restrains the female screw portion from moving forward in an axial direction, and a resin spring that restrains the female screw portion from moving rearward in the axial direction. An impact in the axial direction that acts on the female screw portion is absorbed by one spring, and an impact due to a restoring force at the time of restoration of one spring is absorbed by the other spring, whereby a rod-shaped cosmetic material supported by the rod-shaped cosmetic material support put in screw engagement with the female screw portion is sufficiently protected.

3 Claims, 15 Drawing Sheets

ROD-SHAPED COSMETIC MATERIAL FEEDING CONTAINER

TECHNICAL FIELD

The present disclosure relates to a rod-shaped cosmetic material feeding container that permits a rod-shaped cosmetic material to be protruded and retracted.

BACKGROUND ART

Conventionally, as a rod-shaped cosmetic material feeding container, there has been known the one described in Patent Document 1 cited below. The rod-shaped cosmetic material feeding container described in Patent Document 1 includes a front portion of the container, a rear portion of the container, a movable body, and a female screw member. The rear portion of the container is mounted to the front portion of the container in such a manner as to be rotatable and non-movable in an axial direction in relation to the front portion of the container. The movable body is non-rotatable about the axis and movable in the axial direction in relation to the front portion of the container, supports the rod-shaped cosmetic material at a leading end thereof, and has a male screw at an outer peripheral portion thereof. The female screw member is non-rotatable about the axis in relation to the rear portion of the container, and is provided at an inner peripheral portion thereof with a female screw for screw engagement with the male screw. Relative rotation of the front portion of the container and the rear portion of the container causes a screw part composed of the male screw and the female screw to function in such a manner that the movable body is advanced or retracted, thus the rod-shaped cosmetic material is protruded or retracted through an opening at a leading end of the container.

Particularly, in this rod-shaped cosmetic material feeding container, the female screw member has the female screw and a spring portion which can be contracted and extended in the axial direction, the female screw and the spring portion being provided in this order from a front side toward a rear side, and a rear end of the spring portion is substantially inhibited from moving in the axial direction. It is described, therefore, that when an axial-directionally forward or rearward impact is exerted on the female screw member due, for example, to dropping of the rod-shaped cosmetic material feeding container, the spring portion contracts or extends in the axial direction, attended by an axial-directionally forward or rearward movement of the female screw, and the movable body having the male screw in screw engagement with the female screw is also moved forward or rearward accordingly, with the result that the impact on the rod-shaped cosmetic material can be absorbed, and the rod-shaped cosmetic material can be protected.

CITATION LIST

Patent Literature

[Patent Document 1] Japanese Patent Laid-Open No. 2012-96009

Technical Problem

Here, in the above-mentioned rod-shaped cosmetic material feeding container, as aforementioned, when an impact in the axial direction (rearward or forward) is exerted on the female screw member, the spring portion contracts or extends to thereby absorb the impact. In this case, after the contraction or extension, in order to restore into its original shape, the spring portion vigorously extends or contracts in the opposite sense in the axial direction. Therefore, an impact due to a restoring force is again exerted on the rod-shaped cosmetic material, and, accordingly, further enhancement of the protection of the rod-shaped cosmetic material is desired. In addition, as a pencil-type cosmetic material container such as a rod-shaped cosmetic material feeding container, a compact one that is convenient to carry and has good appearance is demanded.

Thus, an object of the present disclosure is to provide the rod-shaped cosmetic material feeding container that can sufficiently protect the rod shaped cosmetic material and that is rendered compact.

SUMMARY OF INVENTION

A rod-shaped cosmetic material feeding container according to the present disclosure includes a tubular container, a movable body, a female screw portion, a first elastic body and a second elastic body. The tubular container is provided with a front portion of the container and a rear portion of the container. The rear portion of the container is mounted to the front portion of the container in such a manner as to be rotatable about an axis and immovable in an axial direction. The movable body is non-rotatable about the axis and movable in the axial direction in relation to the front portion of the container. The movable body supports a rod-shaped cosmetic material at a leading end thereof and is provided with a male screw at an outer peripheral portion thereof The female screw portion is non-rotatable about the axis in relation to the rear portion of the container and movable in the axial direction. The female screw portion is provided at an inner peripheral portion thereof with a female screw for screw engagement with the male screw. The first elastic body accumulates an elastic force between the front portion of the container and the female screw portion and restrains the female screw portion from moving forward in the axial direction. The second elastic body restrains the female screw portion from moving rearward in the axial direction. Relative rotation of the front portion of the container and the rear portion of the container causes a screw part composed of the male screw and the female screw to function to advance or retract the movable body, whereby the rod-shaped cosmetic material is protruded or retracted through an opening at a leading end of the container. The first elastic body and the second elastic body are disposed along the axial direction in such a manner as to overlap with each other in a radial direction.

According to the rod-shaped cosmetic material feeding container configured as above, the rod-shaped cosmetic material is supported on the leading end of the movable body, and when an impact in the axial direction is exerted on the female screw portion having the female screw for screw engagement with the male screw of the movable body and the female screw portion is moved forward in the axial direction, the forward movement of the female screw portion is restrained by the first elastic body, and the impact is absorbed. Thereafter, a restoring force for restoring the first elastic body into its original shape is exerted on the first elastic body, and the female screw portion is moved rearward. This rearward movement of the female screw portion is restrained by the second elastic body, and the impact due to the restoring force of the first elastic body is absorbed. In addition, when an impact in the axial direction is exerted on the female screw portion and the female screw portion is moved rearward in the axial direction, the rearward movement of the female screw portion is restrained by the second elastic body, and the impact is absorbed. Thereafter, a restoring force for restoring the second elastic body into its original shape is exerted on the second elastic body, and the female screw portion is moved forward. This forward movement of the female screw portion is restrained by the first elastic body, and the impact due to the restoring force of the second elastic body is absorbed. In this way, the impact in the axial direction exerted on the female screw portion is absorbed by the elastic body on one side, and the impact due to the restoring force at the time of restoration of the elastic body on the one side is absorbed by the elastic body on the other side. Therefore, the rod-shaped cosmetic material supported on the leading end of the movable body can be protected sufficiently. Moreover, the first elastic body and the second elastic body are disposed along the axial direction, not in series with each other but in such a manner as to overlap with each other in the radial direction, and, accordingly, an axial-directionally compact structure can be realized.

Here, as a configuration to preferably produce the above described operations, specifically, the following configuration can be listed. The rod-shaped cosmetic material feeding container includes an anti-rotation portion provided in a row with a rear end portion of the second elastic body. The anti-rotation portion is engaged with the rear portion of the container in such a manner as to be non-rotatable about the axis by an axial-directionally rearward elastic urging of the first elastic body.

In addition, as a configuration to preferably produce the above described operations, specifically, the following configuration can be listed. The rod-shaped cosmetic material feeding container includes a female screw member provided with the female screw portion, the second elastic body, and the anti-rotation portion in a row in this order from a front side toward a rear side in the axial direction.

Advantageous Effects of Invention

Thus, according to the present disclosure, there can be provided a rod-shaped cosmetic material feeding container by which a rod-shaped cosmetic material can be protected sufficiently and a compact structure can be realized.

DESCRIPTION OF EMBODIMENTS

Figure 13:
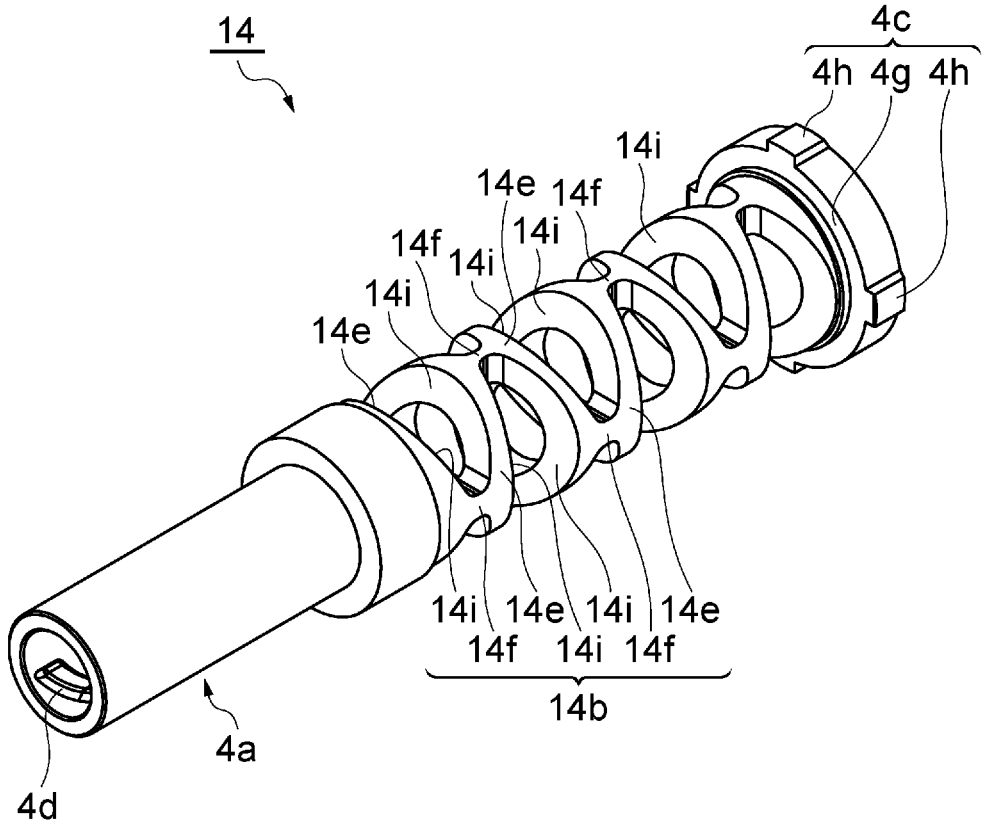
FIG. 13 is a perspective view of a female screw member of a rod-shaped cosmetic material feeding container according to a second embodiment of the present disclosure.
Figure 14:
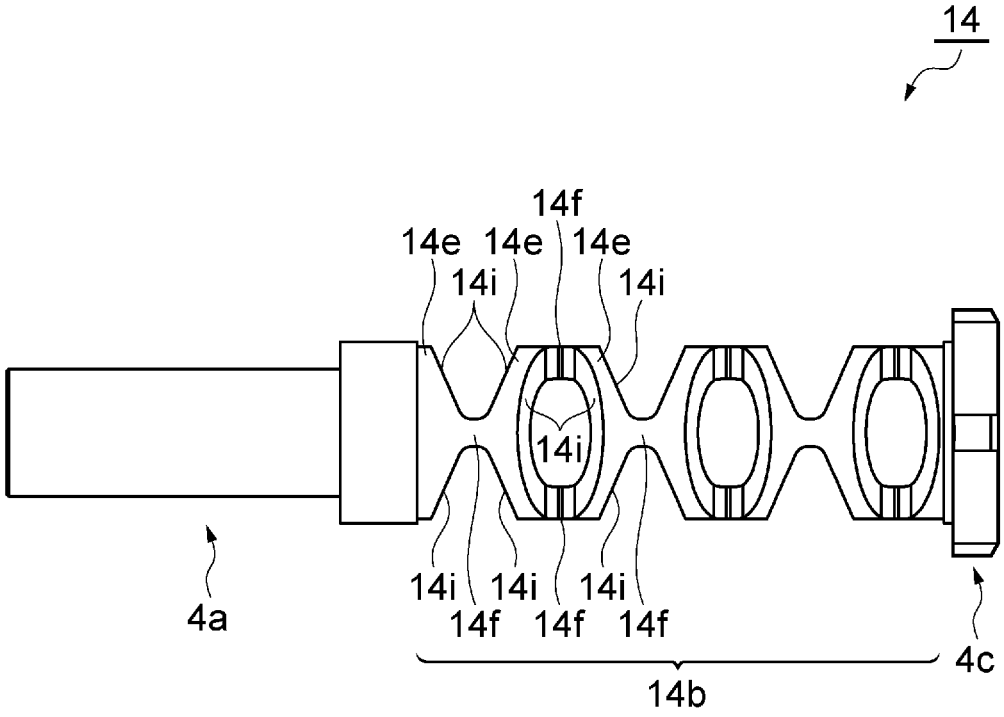
FIG. 14 is a front view of the female screw member shown in FIG. 13.
Figure 15:
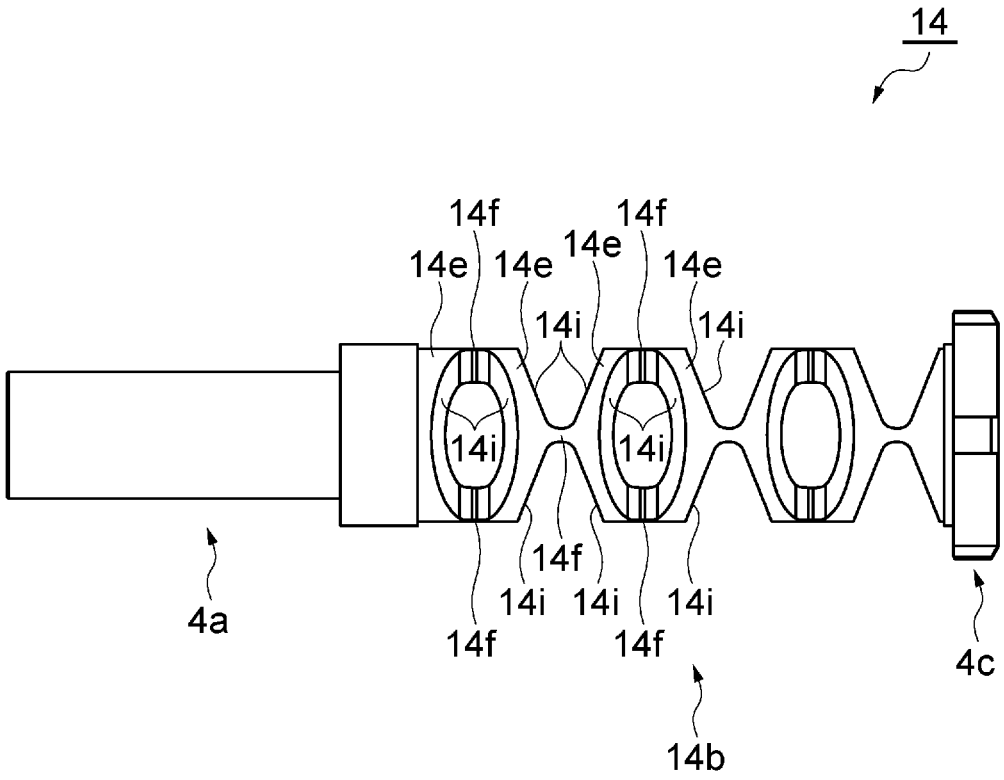
FIG. 15 is a plan view of FIG. 14.

Preferred embodiments of a rod-shaped cosmetic material feeding container according to the present disclosure will be described below referring to FIGS. 1 to 15. FIGS. 1 to 12 illustrate a first embodiment of the present disclosure, and FIGS. 13 to 15 illustrate a second embodiment of the present disclosure. In the drawings, the same elements are denoted by the same reference symbols, and overlapping descriptions will be omitted.

First, the first embodiment illustrated in FIGS. 1 to 12 will be described.

Figure 1:
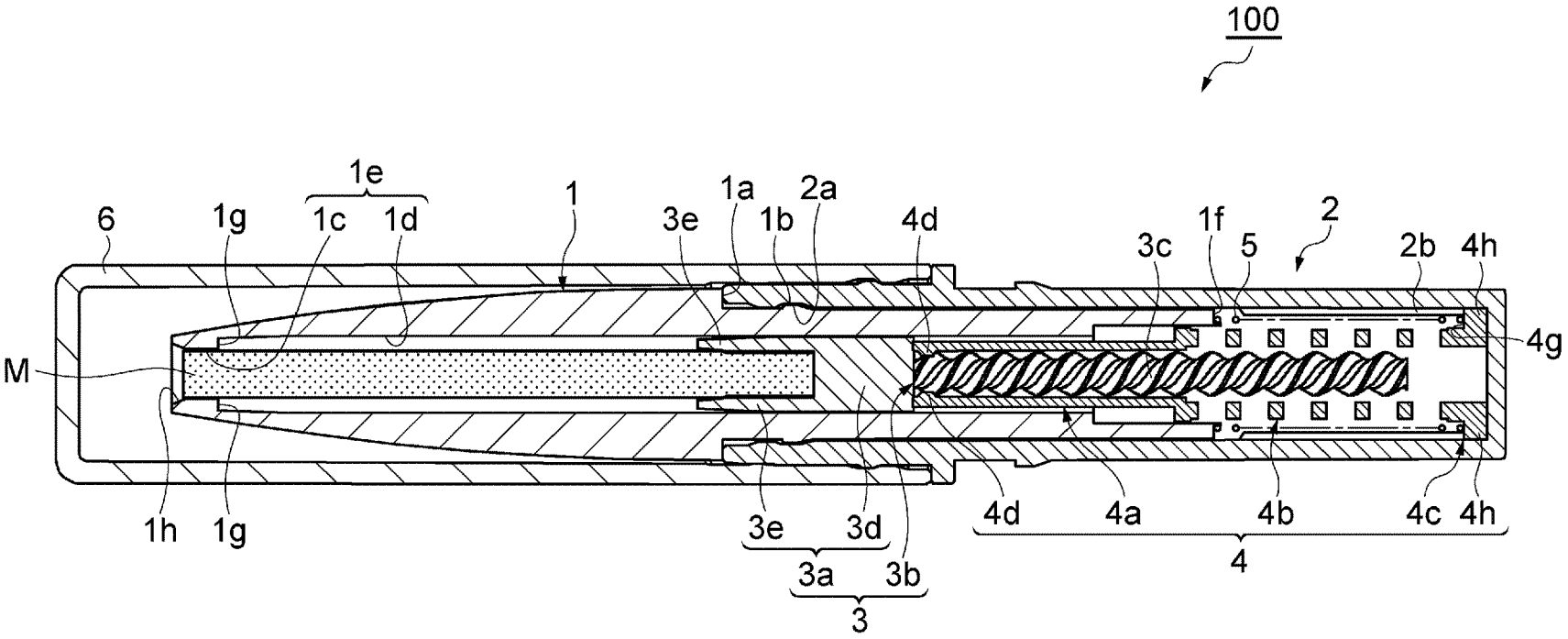
FIG. 1 is a longitudinal sectional view of a rod-shaped cosmetic material feeding container according to a first embodiment of the present disclosure.
Figure 2:
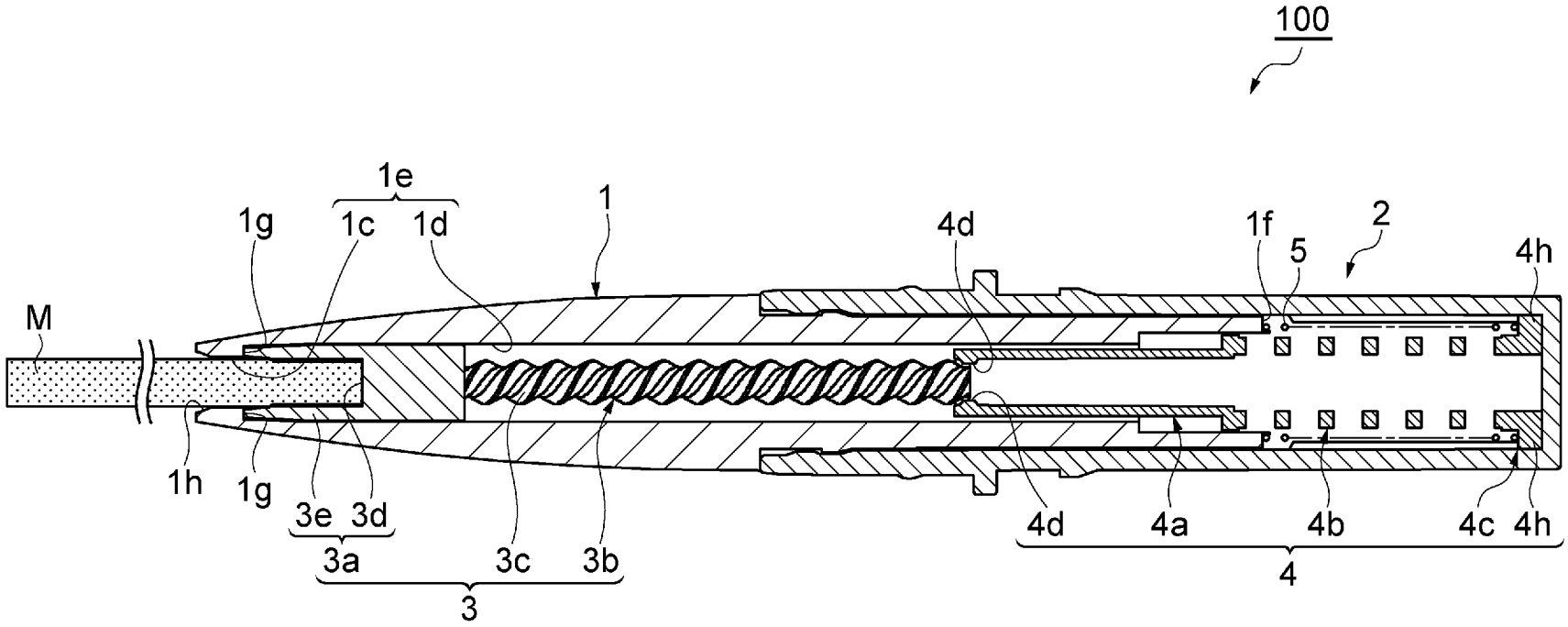
FIG. 2 is a longitudinal sectional view showing a state in which a cap is detached from the rod-shaped cosmetic material feeding container shown in FIG. 1 and a movable body is advanced to an advancement limit.
Figure 3:
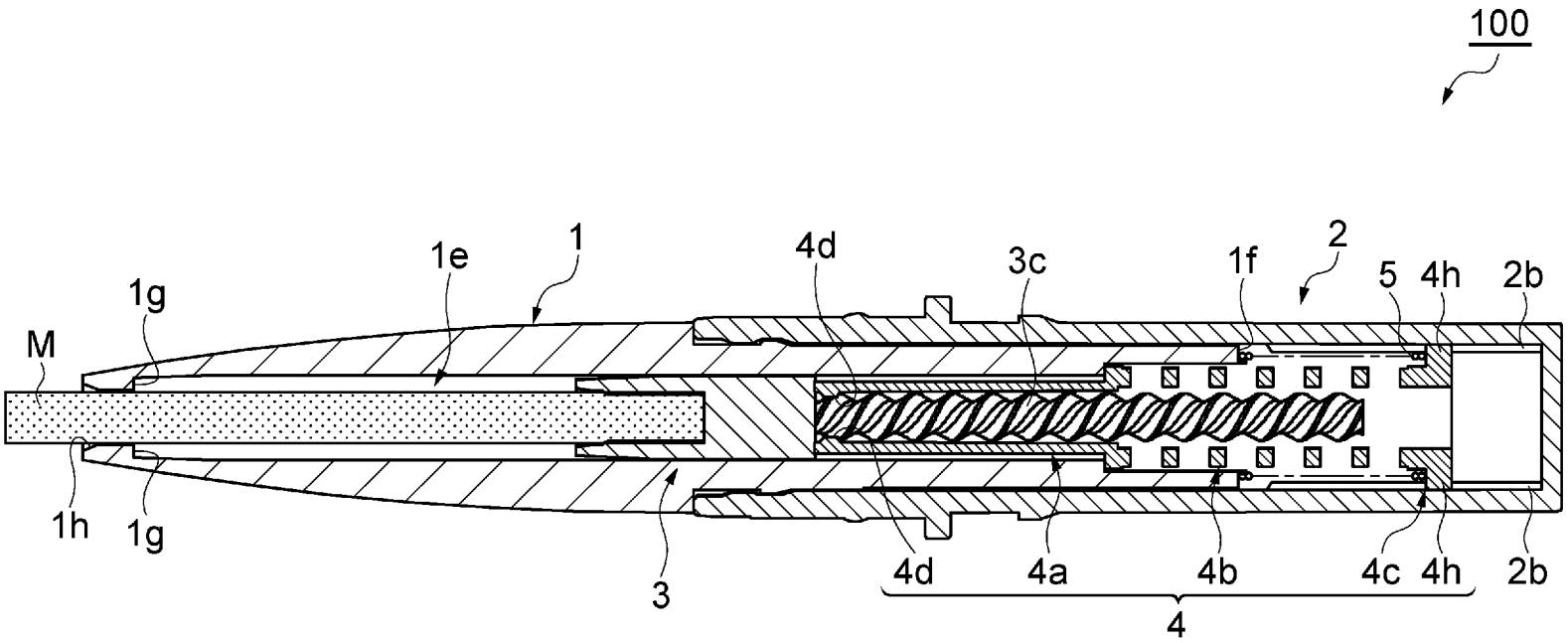
FIG. 3 is a longitudinal sectional view showing a state in which an axial-directionally forward impact is exerted on a female screw member of the rod-shaped cosmetic material feeding container shown in FIG. 1.
Figure 4:
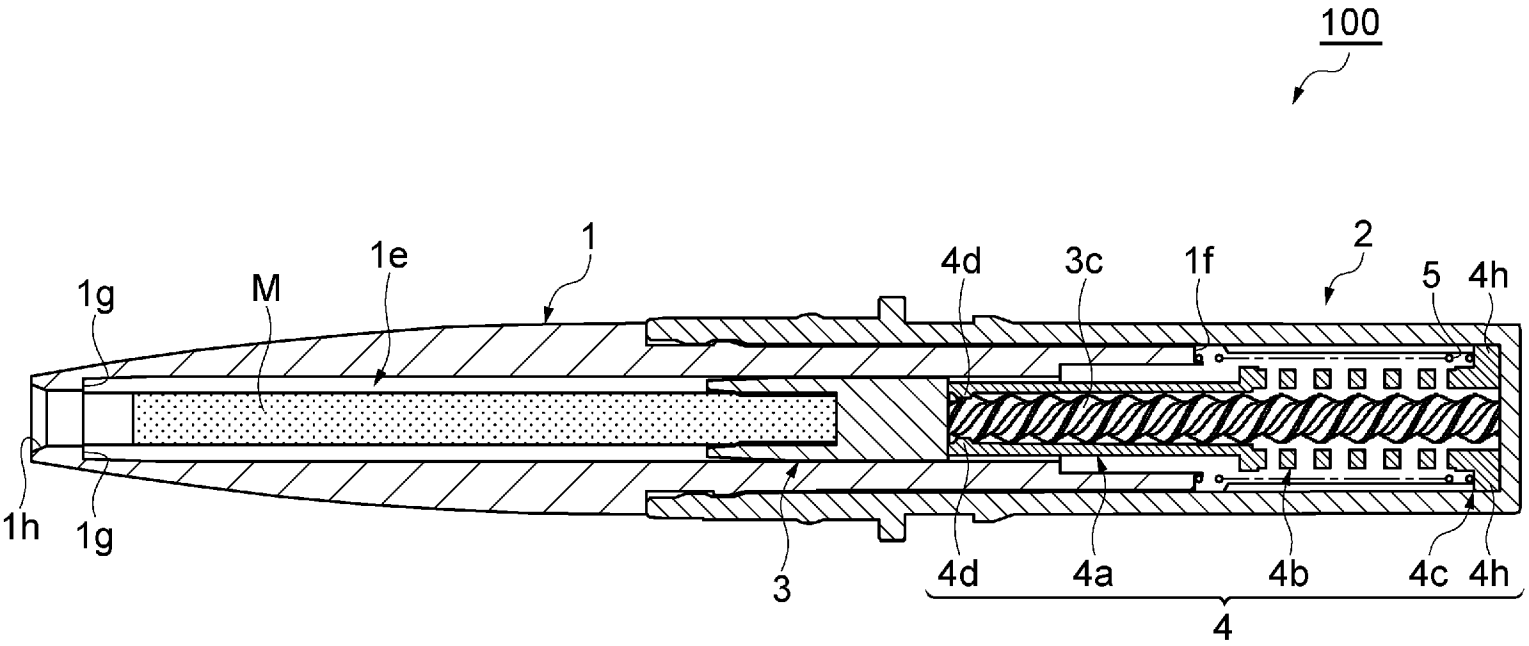
FIG. 4 is a longitudinal sectional view showing a state in which an axial-directionally rearward impact due to a restoring force of an elastic body is exerted on the female screw member, starting from the state illustrated in FIG. 3.
Figure 5:
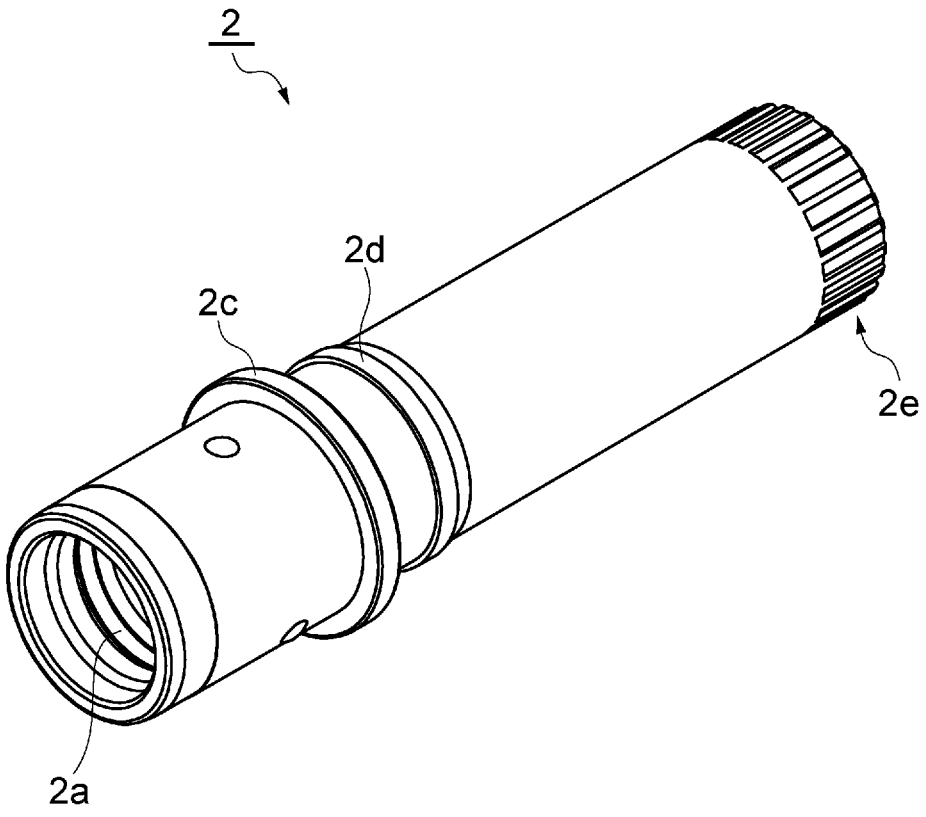
FIG. 5 is a perspective view of a rear portion of the container in FIG. 1.
Figure 6:
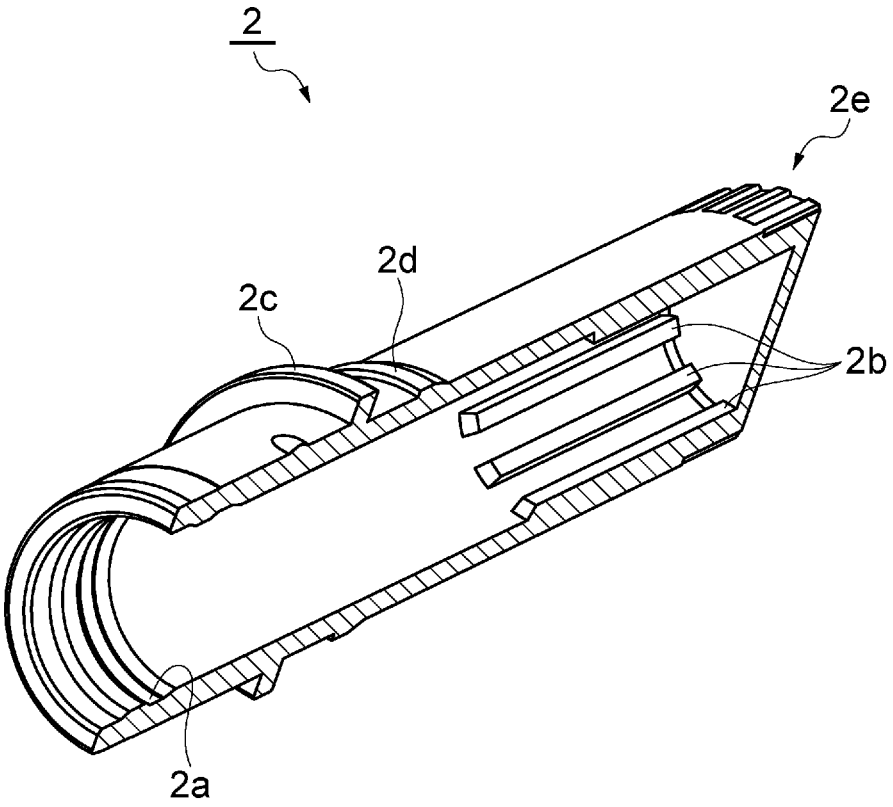
FIG. 6 is a longitudinal perspective view of the rear portion of the container shown in FIG. 5.
Figure 7:
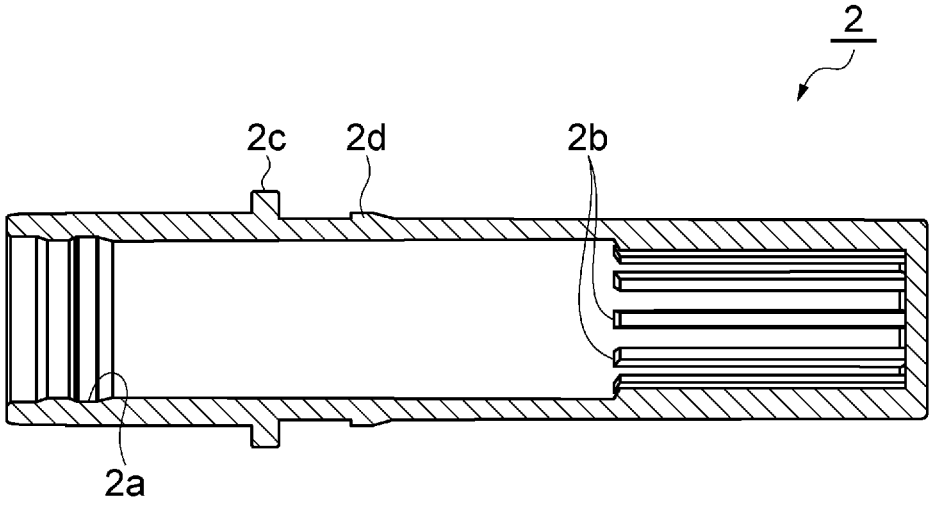
FIG. 7 is a longitudinal sectional view of the rear portion of the container shown in FIGS. 5 and 6.
Figure 8:
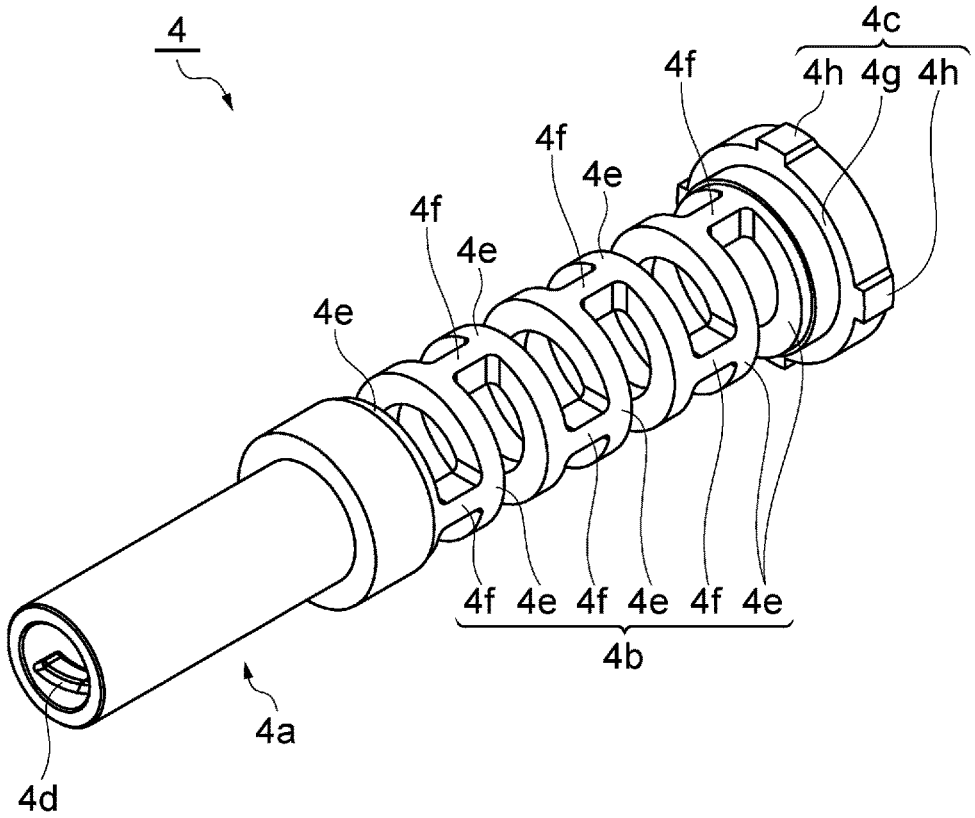
FIG. 8 is a perspective view of the female screw member in FIG. 1.
Figure 9:
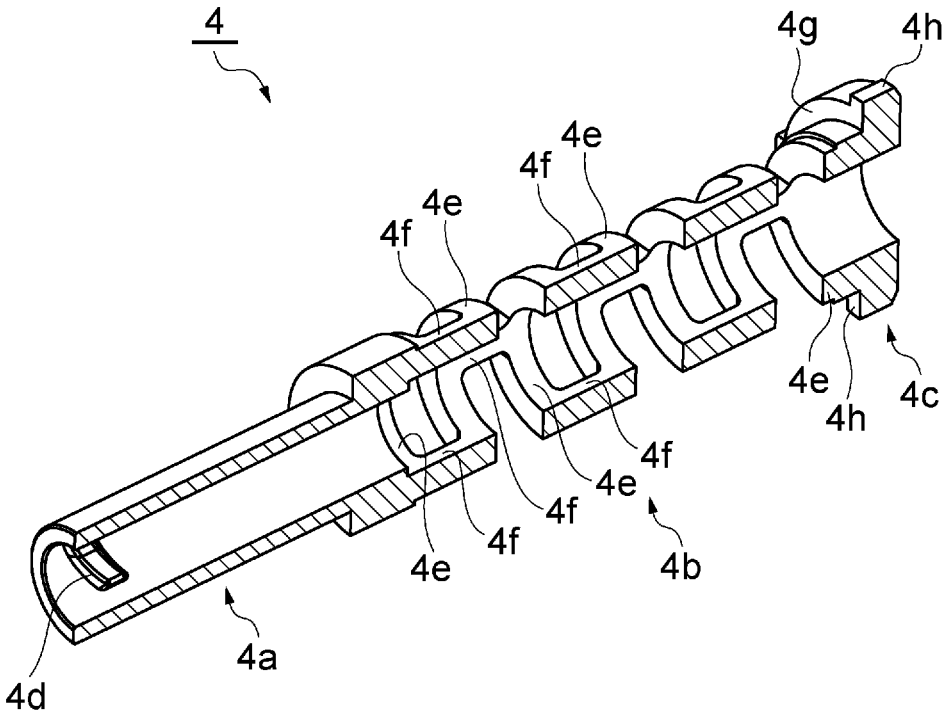
FIG. 9 is a longitudinal perspective view of the female screw member shown in FIG. 8.
Figure 10:
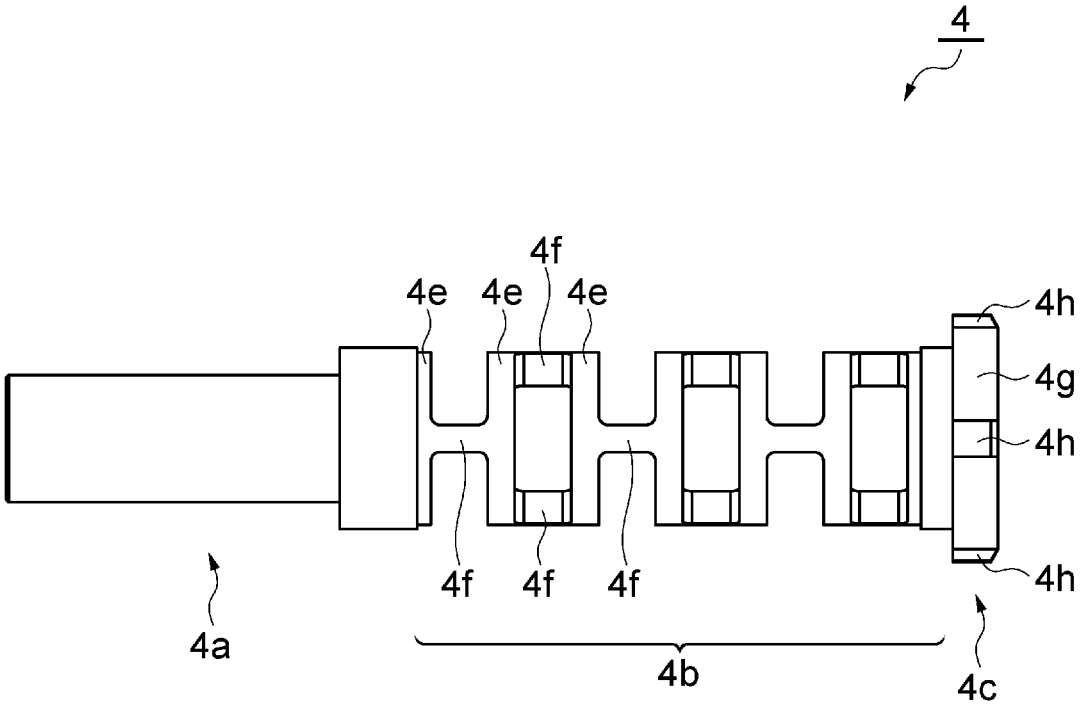
FIG. 10 is a front view of the female screw member shown in FIG. 8.
Figure 11:
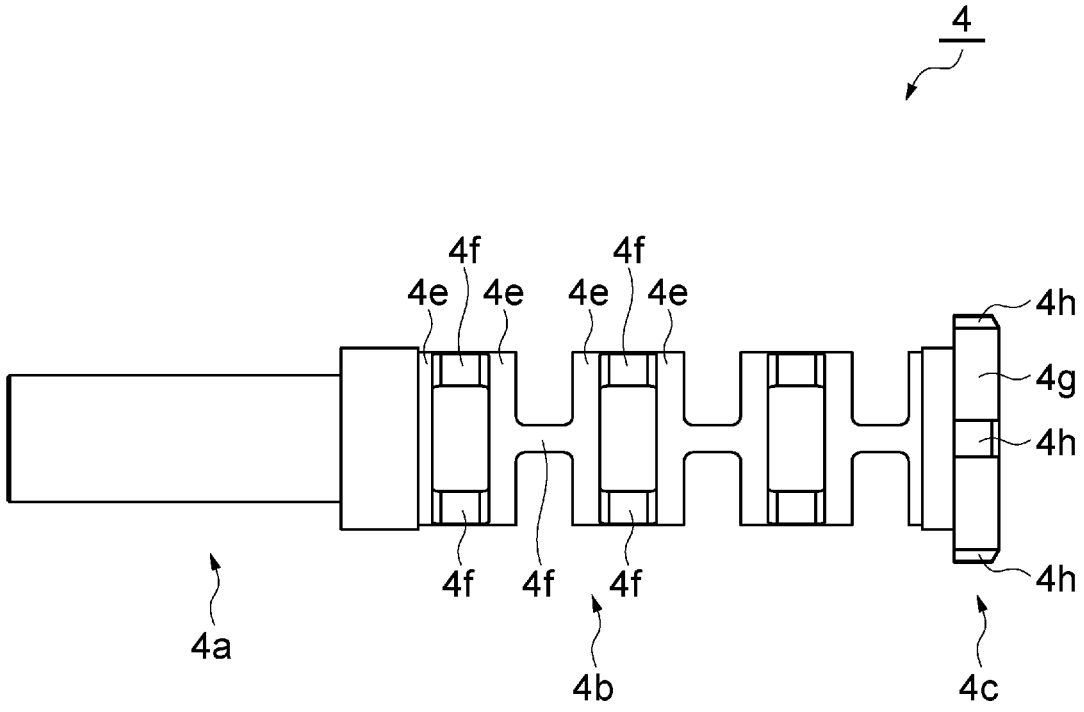
FIG. 11 is a plan view of FIG. 10.
Figure 12:
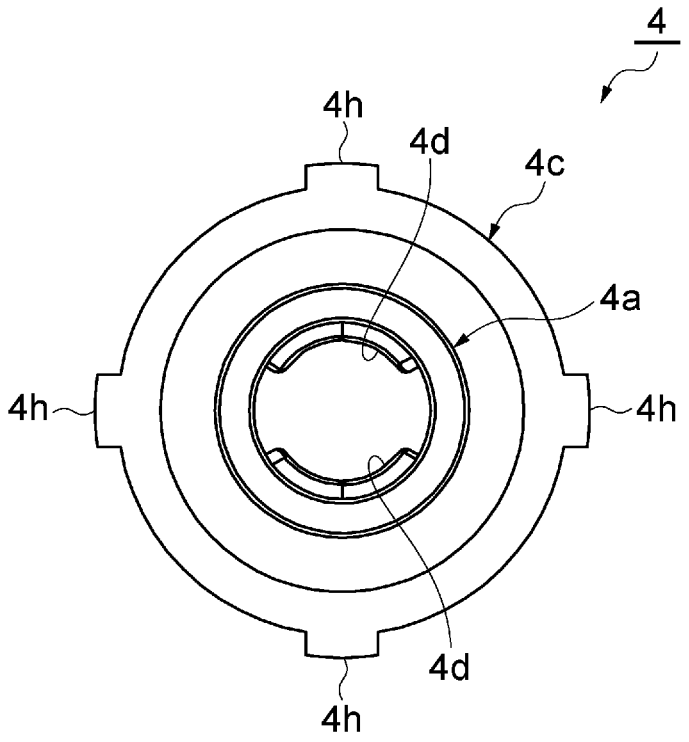
FIG. 12 is a left side view of FIG. 10.

FIG. 1 is a longitudinal sectional view of a rod-shaped cosmetic material feeding container according to a first embodiment of the present disclosure; FIG. 2 is a longitudinal sectional view showing a state in which a cap is detached from the rod-shaped cosmetic material feeding container and a movable body is advanced to an advancement limit; FIG. 3 is a longitudinal sectional view showing a state in which an axial-directionally forward impact is exerted on a female screw member of the rod-shaped cosmetic material feeding container shown in FIG. 1; FIG. 4 is a longitudinal sectional view showing a state in which an axial-directionally rearward impact due to a restoring force of an elastic body is exerted on the female screw member, starting from the state illustrated in FIG. 3; FIGS. 5 to 7 each illustrates a rear portion of the container; and FIGS. 8 to 12 each illustrates the female screw member. The rod-shaped cosmetic material feeding container of the present embodiment is a container that accommodates one of various rod-shaped cosmetic material such as an eyeliner, an eyebrow pencil, a lip liner, a concealer, etc. such that the rod-shaped cosmetic material can be appropriately protruded and retracted by a user, as required.

As illustrated in FIG. 1, a rod-shaped cosmetic material feeding container 100 has a thin and elongate round rod-like overall shape like a writing implement. Here, the rod-shaped cosmetic material feeding container 100 shown in FIG. 1 will be described. However, the rod-shaped cosmetic material feeding container 100 may, as a so-called rod-shaped cosmetic cartridge, be used in the state of being mounted to one end side of a cartridge accommodating container (not shown) in a freely detachable (or non-detachable) manner.

The rod-shaped cosmetic material feeding container 100 is a tubular container of which the external appearance is composed of a leading tube 1 constituting a front portion of the container and a main body tube 2 constituting a rear portion of the container. In the leading tube 1 and the main body tube 2, there are accommodated a rod-shaped cosmetic material M, a rod-shaped cosmetic material support 3 that is a movable body supporting the rod-shaped cosmetic material M and including a screw part, a female screw member 4 that includes a screw part and an elastic body 4*b*, and an elastic body 5 different from the elastic body 4*b*. Note that a cap 6 is detachably mounted to a front side of the main body tube 2 in such a manner as to cover the leading tube 1.

As illustrated in FIG. 1 and FIGS. 5 to 7, the main body tube 2 is bottomed cylinder-like in shape, and at its inner peripheral surface on the leading end side, a recess 2*a* for engagement with the leading tube 1 in the axial direction is provided in a circular annular shape. In addition, at an inner peripheral surface of a rear portion of the main body tube 2, a plurality of ribs 2*b* extending forward in the axial direction from a bottom portion are provided along a circumferential direction, as parts for engagement with the female screw member 4 in a rotating direction. Note that reference symbols 2*c*, 2*d*, and 2*e* related to the main body tube 2 will be described later.

The female screw member 4 is integrally formed from a resin. As illustrated in FIG. 1 and FIGS. 8 to 12, the female screw member 4 is formed in a substantially cylindrical shape, and a female screw portion 4*a*, an elastic body (second elastic body) 4*b*, and an anti-rotation portion 4*c* are provided in a row in this order from the leading end side toward the rear end side of the female screw member 4.

The female screw portion 4*a* has a cylindrical shape, and a pair of screw engagement projections (female screw) 4*d* constituting one-side portion of the screw part are oppositely provided at an inner peripheral surface on the leading end side of the female screw portion 4*a*.

The elastic body 4*b*, here, is a resin spring formed to be integral with the female screw portion 4*a* and the anti-rotation portion 4*c*. The resin spring 4*b* includes a plurality of annular portions 4*e* which are substantially rectangular in sectional shape, have a constant thickness, and are aligned at intervals in the axial direction. The annular portions 4*e* are interconnected by a pair of connection portions 4*f* which extend in the axial direction and which are opposed to each other in a radial direction. Here, the annular portions 4*e* have a circular annular shape, and the pair of connection portions 4*f* are disposed at a 90° shift about the axis in relation to the pair of connection portions 4*f* to which they are adjacent in the axial direction. Besides, the resin spring 4*b* is not twisted (is hard to be twisted) in the rotating direction, because of its having the above-mentioned annular portions 4*e* and connection portions 4*f*. The resin spring 4*b* restrains the female screw portion 4*a* from moving rearward in the axial direction.

The anti-rotation portion 4*c* includes a cylindrical portion 4*g* provided in a row with a rear end portion of the resin spring 4*b* and larger in diameter than the resin spring 4*b*, and a plurality of (here, four) projections 4*h* provided at an outer peripheral surface of the cylindrical portion 4*g* at regular intervals along the circumferential direction. The projections 4*h* are for engagement with the ribs 2*b* of the main body tube 2 in the rotating direction.

In addition, as depicted in FIG. 1, the female screw member 4 is inserted into the main body tube 2 from a rear end side thereof, and its projections 4*h* enter between the ribs 2*b* (see FIGS. 6 and 7) of the main body tube 2 and engage with the ribs 2*b* in the rotating direction, whereby the female screw member 4 is mounted in such a manner as to be movable in the axial direction and non-rotatable (synchronously rotatable) about the axis in relation to the main body tube 2.

The leading tube 1 is configured in the shape of a stepped cylinder having a stepped portion 1*a* at an outer peripheral surface of an intermediate portion in the axial direction. Of the leading tube 1, a small-diameter cylindrical portion continuing from the stepped portion la to the rear side is made to be an inserted portion inserted in the main body tube 2, and a cylindrical portion continuing from the stepped portion 1*a* to the front side, being large in diameter and tapered toward the leading end is made to be a grip portion which protrudes from the leading end of the main body tube 2 and which is gripped by the user. At that outer peripheral surface of a portion of the leading tube 1 which is on the rear side from the stepped portion 1*a*, a projected portion 1*b* for engagement with the recess 2*a* of the main body tube 2 in the axial direction is provided in a circular annular shape.

The leading tube 1 is provided with a rod-shaped cosmetic material bore 1*c* which extends rearward from an opening 1*h* at the leading end and which permits the rod-shaped cosmetic material M to slide therein. At a plurality of portions (here, equally spaced four positions) of the periphery of the rod-shaped cosmetic material bore 1*c*, support piece grooves 1*d* which accommodate support pieces 3*e* (described later) of the rod-shaped cosmetic material support 3 and which permit the support pieces 3*e* to slide therein are provided in a row, over a range from the vicinity of the opening 1*h* to a rear portion of the leading tube 1. In addition, the rod-shaped cosmetic material bore 1*c* and the support piece grooves 1*d* at the periphery of the rod-shaped cosmetic material bore 1*c* constitute an advancement/retraction bore 1*e* in which the rod-shaped cosmetic material M and the support pieces 3*e* slide. Here, the rod-shaped cosmetic material bore 1*c* has a circular sectional shape like that of the rod-shaped cosmetic material M, whereas the support piece grooves 1*d* are substantially rectangular in sectional shape. Besides, leading end surfaces 1*g* of the support piece grooves 1*d* constitute an advancement limit for the rod-shaped cosmetic material support 3 against which the leading ends of the support pieces 3*e* of the rod-shaped cosmetic material support 3 are abutted (see FIG. 2).

Note that the advancement/retraction bore 1*e*, which is non-circular in sectional shape, is provided to extend up to a position to which the female screw member 4 can be moved forward when an axial-directionally forward impact is exerted on the female screw member 4 (see FIG. 3) and the female screw member 4 is moved forward (described in detail later). Over a range from a rear end of the advancement/retraction bore 1*e* being non-circular in sectional shape (the position to which the female screw member 4 is moved forward) to an opening at the rear end of the leading tube 1, there is formed a tubular bore which is circular in sectional shape and in which the rod-shaped cosmetic material support 3 (particularly, a support portion 3*a* described later) and the female screw portion 4*a* of the female screw member 4 can be moved.

In addition, the leading tube 1 is inserted into the main body tube 2 starting from its inserted portion, its stepped portion la is abutted against a leading end surface of the main body tube 2, and its projected portion lb is engaged with the recess 2*a* of the main body tube 2 in the axial direction, whereby the leading tube 1 is mounted to the main body tube 2 in such a manner as to be immovable in the axial direction and rotatable about the axis in relation to the main body tube 2.

The rod-shaped cosmetic material support 3 includes a support portion 3*a* for supporting a rear end portion of the rod-shaped cosmetic material M, and a shaft body portion 3*b* on the rear side from the support portion 3*a*. The shaft body portion 3*b* is a shaft body extending in the axial direction, and, at an outer peripheral surface of the shaft body portion 3*b*, a male screw 3*c* constituting an other-side portion of the screw part is provided in such a manner as to extend in the axial direction. Note that a leading end of the male screw 3*c* is made to be lower than the male screw 3*c* on the rear side from the leading end such as to release the screw engagement with the screw engagement projections 4*d* when a further rotating operation in a feeding-back direction is carried out at a retraction limit of the rod-shaped cosmetic material support 3. In addition, a terminal end (rear end) of the male screw 3*c* is configured to be relieved rearward as it is, such as to release the screw engagement with the screw engagement projections 4*d* when a further rotating operation in the feeding-out direction is carried out at the advancement limit of the rod-shaped cosmetic material support 3 (the details will be described later).

The support portion 3*a* on the front side from the shaft body portion 3*b* includes a base portion 3*d* and support pieces 3*e*. The base portion 3*d* has a circular overall sectional shape coinciding substantially with the overall shape of the rod-shaped cosmetic material M and against which a rear end surface of the rod-shaped cosmetic material M is abutted. The support pieces 3*e* are provided at a plurality of positions (here, equally spaced four positions) in the circumferential direction of the outer peripheral surface of the base portion 3*d* in such a manner as to protrude toward the leading end side and support therebetween a rear end portion of the rod-shaped cosmetic material M abutted against the base portion 3*d*.

Besides, the rod-shaped cosmetic material support 3 is inserted into a rear-end-side portion of the leading tube 1 starting from the leading end side thereof and is inserted into the advancement/retraction bore le in such a manner that its base portion 3*d* enters the rod-shaped cosmetic material bore 1*c* of the leading tube 1 and that its support pieces 3*e* enter the support piece grooves 1*d* of the leading tube 1. Therefore, the support piece grooves 1*d* in which the support pieces 3*e* of the rod-shaped cosmetic material support 3 enter are utilized as anti-rotation means for the rod-shaped cosmetic material support 3, so that the rod-shaped cosmetic material support 3 is mounted to the leading tube 1 in such a manner as to be movable in the axial direction and non-rotatable about the axis in relation to the leading tube 1. In this state, the shaft body portion 3*b* of the rod-shaped cosmetic material support 3 enters into the female screw member 4, resulting in a state in which the male screw 3*c* of the rod-shaped cosmetic material support 3 is in screw engagement with the screw engagement projections 4*d* of the female screw member 4.

In addition, an elastic body (first elastic body) 5 is interposed between a rear end surface 1*f* of the leading tube 1 and the cylindrical portion 4*g* of the anti-rotation portion 4*c* of the female screw member 4. The elastic body 5 here is a coil spring (compression spring), and is set to have a lower spring constant than that of the above-mentioned resin spring 4*b*. The coil spring 5 is disposed in such a manner as to surround the resin spring 4*b* of the female screw member 4, in other words, disposed along the axial direction in such a manner as to externally overlap with the resin spring 4*b* in the radial direction. Note that end portions of the coil spring 5 may be fixed or may not be fixed.

In a state in which the rod-shaped cosmetic material support 3 is located at the retraction limit which is an initial position shown in FIG. 1, the coil spring 5 biases (elastically urges) a projection 4*h* entering between the ribs 2*b* of the main body tube 2 and the cylindrical portion 4*g*, namely, the anti-rotation portion 4*c* in such a manner that they make close contact with a bottom portion of the main body tube 2, thereby engaging the anti-rotation portion 4*c* (projection 4*h*) with the main body tube 2 in such a manner as to be non-rotatable in relation to the main body tube 2. Besides, the coil spring 5 accumulates a biasing force (elastically urging force) between the leading tube 1 and the female screw member 4 (female screw portion 4*a*), and restrains the female screw member 4 (female screw portion 4*a*) from moving forward in the axial direction.

Note that as aforementioned, the rod-shaped cosmetic material feeding container 100 can be formed as a rod-shaped cosmetic material cartridge, and can be used in the state of being mounted to one end side of an elongate cylindrical cartridge accommodating container (not shown). Specifically, as particularly depicted in FIGS. 5 to 7, the rod-shaped cosmetic material cartridge and the cartridge accommodating container can be used as an integrated elongate rod-shaped cosmetic material feeding container by a method wherein that portion of the main body tube 2 which is on the rear side from a flange portion 2*c* provided at an outer peripheral surface on the front side of the main body tube 2 is inserted in an opening on one end side of the cartridge accommodating container and the flange portion 2*c* is abutted against a leading end surface of the cartridge accommodating container, and a circular annular projected portion 2*d* provided at an outer peripheral surface on the rear side from the flange portion 2*c* of the main body tube 2 is engaged with a recess (not shown) at an inner peripheral surface of the cartridge accommodating container in the axial direction, whereby the main body tube 2 is set to be freely detachable or non-detachable to the cartridge accommodating container in the axial direction, and wherein a knurled portion 2*e* having recesses and projections densely provided side by side along the circumferential direction at an outer peripheral surface of a rear portion of the main body tube 2 and extending by a predetermined length in the axial direction is engaged with a knurled portion (not shown) of the cartridge accommodating container in the rotating direction, whereby the main body tube 2 is mounted to the cartridge accommodating container in such a manner as to be non-rotatable about the axis in relation to the cartridge accommodating container. In this case, the leading tube 1 constitutes a front portion of the container, whereas the cartridge accommodating container united with the main body tube 2 constitutes a rear portion of the container.

Now, operations of the rod-shaped cosmetic material feeding container 100 will be described below.

When the cap 6 shown in FIG. 1 is detached and the leading tube 1 and the main body tube 2 are put into relative rotation (rotating operation) in the feeding-out direction which is one direction by the user, a screw engagement action of the screw part composed of the male screw 3*c* of the rod-shaped cosmetic material support 3 and the screw engagement projections 4*d* of the female screw member 4 takes effect, whereby the rod-shaped cosmetic material support 3 is advanced, and the rod-shaped cosmetic material M emerges from the opening 1*h* at the leading end of the leading tube 1, so that the rod-shaped cosmetic material M can be applied (see FIG. 2). In this instance, a pressure (brush or pen pressure) at the time of applying the rod-shaped cosmetic material M is absorbed by the resin spring 4*b*, so that the rod-shaped cosmetic material M can be applied without hindrance.

When the application is finished and the leading tube 1 and the main body tube 2 are put into relative rotation (rotating operation) in the feeding-back direction which is the direction opposite to the one direction by the user, the rod-shaped cosmetic material support 3 is retracted, and the rod-shaped cosmetic material M is retracted from the opening 1*h* at the leading end of the leading tube 1.

Here, in the case where the rod-shaped cosmetic material feeding container 100 is dropped, for example, starting from the leading end side, the impact of the dropping causes first the female screw portion 4*a* (female screw member 4) to be moved forward in the axial direction, as shown in FIG. 3. This axial-directionally forward movement of the female screw portion 4*a* is restrained by the coil spring 5, with accumulation of a biasing force (elastically urging force), and the impact is absorbed (buffered). Thereafter, a restoring force for restoring (returning) into an initial shape acts on the coil spring 5, and the female screw portion 4*a* is moved rearward in the axial direction, as illustrated in FIG. 4. This axial-directionally rearward movement of the female screw portion 4*a* is restrained by the resin spring 4*b*, with accumulation of a biasing force (elastically urging force), and the impact due to the restoring force of the coil spring 5 is absorbed (buffered). Then, the impact-absorbing operations in the axial direction are repeated, resulting in damping.

On the other hand, when the rod-shaped cosmetic material feeding container 100 is dropped, for example, starting from the rear end side, the impact of the dropping causes first the female screw portion 4*a* to be moved rearward in the axial direction, as shown in FIG. 4. This axial-directionally rearward movement of the female screw portion 4*a* is restrained by the resin spring 4*b*, with accumulation of a biasing force (elastically urging force), and the impact is absorbed (buffered). Thereafter, a restoring force for restoring (returning) into an initial shape acts on the resin spring 4*b*, and the female screw portion 4*a* is moved forward in the axial direction, as illustrated in FIG. 3. This axial-directionally forward movement of the female screw portion 4*a* is restrained by the coil spring 5, with accumulation of a biasing force (elastically urging force), and the impact due to the restoring force of the resin spring 4*b* is absorbed (buffered). Then, the impact-absorbing operations in the axial direction are repeated, resulting in damping.

Thus, in the present embodiment, the impact in the axial direction exerted on the female screw portion 4*a* is absorbed by one spring 4*b* (5), and the impact due to the restoring force at the time of restoration of one spring 4*b* (5) is absorbed by the other spring 5 (4*b*); therefore, the rod-shaped cosmetic material M supported by the rod-shaped cosmetic material support 3 in screw engagement with the female screw portion 4*a* (screw engagement projections 4*d*) can be protected sufficiently. Moreover, both the springs, namely, the coil spring 5 and the resin spring 4*b* are disposed along the axial direction, not in series with each other but in such a manner as to overlap with each other in the radial direction, and, therefore, the rod-shaped cosmetic material feeding container 100 can be rendered compact in the axial direction.

Note that as aforementioned, when the rod-shaped cosmetic material feeding container 100 integrates with the cartridge accommodating container, as a rod-shaped cosmetic material cartridge, naturally, the same operation/working-effect as above can be obtained.

Incidentally, in the rod-shaped cosmetic material feeding container 100 as above, when the rotating operation in the feeding-out direction by the user is continued to cause the rod-shaped cosmetic material support 3 to reach the advancement limit, as shown in FIG. 2, and the rotating operation in the same direction is further continued, since the resin spring 4*b* is not twisted and the terminal end of the male screw 3*c* is relieved rearward as it is, the screw engagement between the screw engagement projections 4*d* and the male screw 3*c* is released, accompanied by contraction of the resin spring 4*b*. Thereafter, the screw engagement projections 4*d* are pushed forward by the biasing force of the resin spring 4*b* to again come into screw engagement with the male screw 3*c*. The screw engagement and the release of the screw engagement are repeated, so that an overloading does not occur.

In addition, when the rotating operation in the feeding-back direction by the user is continued to cause the rod-shaped cosmetic material support 3 to reach the retraction limit which is an initial position shown in FIG. 1 and the rotating operation in the same direction is further continued, since the resin spring 4*b* is not twisted and the leading end of the male screw 3*c* is set to be low, the screw engagement between the male screw 3*c* and the screw engagement projections 4*d* is released, and idle rotation occurs, so that an overloading does not occur.

Note that in the case where a spring which would be twisted by a rotating operation at an advancement or retraction limit, for example, an ordinary coil spring or a helical resin spring or the like is used in place of the resin spring 4*b* which is not twisted even upon a rotating operation at the above-mentioned advancement or retraction limit, when the rod-shaped cosmetic material support 3 reaches the advancement limit, the screw engagement between the screw engagement projections 4*d* and the male screw 3*c* is released after the coil spring or the helical resin spring is twisted to a certain extent, and, thus, a time lag would be generated. Besides, when the rod-shaped cosmetic material support 3 reaches the retraction limit, idle rotation starts after the coil spring or the helical resin spring is twisted to a certain extent, and, thus, a time lag is generated. In other words, in the case where a coil spring or a helical resin spring or the like is used in the female screw member 4, a time lag is generated at the advancement limit and at the retraction limit; on the other hand, by using the resin spring 4*b* which is not twisted in the rotating direction as in the present embodiment, generation of a time lag at the advancement limit and at the retraction limit can be inhibited, and damage to component parts can be prevented.

FIG. 13 is a perspective view of a female screw member of a rod-shaped cosmetic material feeding container according to a second embodiment of the present disclosure, FIG. 14 is a front view of the same, and FIG. 15 is a plan view of the same.

As illustrated in FIGS. 13 to 15, the rod-shaped cosmetic material feeding container of the second embodiment differs from the rod-shaped cosmetic material feeding container of the first embodiment in that a female screw member 14 having a resin spring 14*b* obtained by changing the shape of the resin spring 4*b* is used in place of the female screw member 4.

Specifically, the resin spring 14*b* has a configuration wherein annular portions 14*e* differing in shape from those in the first embodiment are aligned in the axial direction, and the annular portions 14*e* are interconnected by a pair of connection portions 14*f* which extend shortly in the axial direction and are opposed to each other in a radial direction; like in the first embodiment, the pair of connection portions 14*f* are disposed at a 90° shift about the axis in relation to the pair of connection portions 14*f* to which they are adjacent in the axial direction.

The annular portions 14*e* have a configuration wherein their portions opposed to (facing) each other along the circumferential direction over a range from one-side connection portion 14*f* toward the other-side connection portion 14*f* of the pair of connection portions 14*f* have inclined surfaces 14*i* inclined in such a manner as to be spaced more away from the opposed (facing) annular portion 14*e* on the opposite side in going radially outward.

More specifically, in a side view in which the pair of connection portions 14*f* overlap with each other (for example, see FIG. 14), a V and an inverted V are formed by the mutually opposed inclined surfaces 14*i* in such a manner as to be aligned in the vertical direction with the connection portion 14*f* interposed therebetween; in addition, adjacently to this, in a plan view in which the pair of connection portions 14*f* overlap with each other (for example, see FIG. 15), a V and an inverted V are formed by the mutually opposed inclined surfaces 14*i* in such a manner as to be aligned in the left-right direction with the connection portion 14*f* interposed therebetween. These aligned patterns are repeated along the axial direction.

Even a resin spring 14*b* configured in this manner is not twisted (is hard to be twisted) in the rotating direction, like in the first embodiment, and, naturally, the same operation/working-effect as in the first embodiment can be obtained.

While the present disclosure has been specifically described above with reference to the embodiments thereof, the present disclosure is not limited to the above embodiments. For instance, while the first elastic body has been a coil spring whereas the second elastic body has been either of the resin springs 4*b* or 14*b* described in the first and the second embodiments as specially preferable in the above embodiments, the first elastic body may, for example, be a resin spring or the like whereas the second elastic body may, for example, be a rigid coil spring or the like.

In addition, while the first elastic body has been disposed on the outside of the second elastic body for realizing a simple structure in the above embodiments, the first elastic body may be disposed on the inside of the second elastic body.

Furthermore, the male screw and the female screw may be any ones that function in the same manner as screw threads, such as a group of intermittently disposed projections or a group of helically and intermittently disposed projections, and the screw engagement projections may be a continuous screw thread.

What is claimed is:

1. A rod-shaped cosmetic material feeding container comprising:

a tubular container provided with a front portion of the container and a rear portion of the container, the rear portion of the container mounted to the front portion of the container in such a manner as to be rotatable about an axis and immovable in an axial direction;

a movable body non-rotatable about the axis and movable in the axial direction in relation to the front portion of the container, the movable body supporting a rod-shaped cosmetic material at a leading end thereof and provided with a male screw at an outer peripheral portion thereof;

a female screw portion non-rotatable about the axis in relation to the rear portion of the container and movable in the axial direction, the female screw portion being provided at an inner peripheral portion thereof with a female screw for screw engagement with the male screw;

a first elastic body that accumulates an elastic force between the front portion of the container and the female screw portion and restrains the female screw portion from moving forward in the axial direction; and a second elastic body that restrains the female screw portion from moving rearward in the axial direction, wherein relative rotation of the front portion of the container and the rear portion of the container causes a screw part composed of the male screw and the female screw to function to advance or retract the movable body, whereby the rod-shaped cosmetic material is protruded or retracted through an opening at a leading end of the container, the first elastic body and the second elastic body are disposed along the axial direction in such a manner as to overlap with each other in a radial direction.

2. The rod-shaped cosmetic material feeding container according to claim 1, further comprising:

an anti-rotation portion provided in a row with a rear end portion of the second elastic body, wherein the anti-rotation portion is engaged with the rear portion of the container in such a manner as to be non-rotatable about the axis by an axial-directionally rearward elastic urging of the first elastic body.

3. The rod-shaped cosmetic material feeding container according to claim 2, further comprising:

a female screw member provided with the female screw portion, the second elastic body, and the anti-rotation portion in a row in this order from a front side toward a rear side in the axial direction.

* * * * *